United States Patent [19]

Ruscitti

[11] 4,165,014

[45] Aug. 21, 1979

[54] CAPS HAVING FRANGIBLE OPENING MEANS

[76] Inventor: Tomaso Ruscitti, Via Amedeo d'Aosta 11, Milan, Italy

[21] Appl. No.: 877,685

[22] Filed: Feb. 14, 1978

[51] Int. Cl.[2] ..... B65D 41/32

[52] U.S. Cl. ..... 220/266; 220/281; 220/85 P; 220/306; 222/182

[58] Field of Search ..... 220/265, 266, 281, 85 P, 220/306; 222/182, 541

[56] References Cited

U.S. PATENT DOCUMENTS 3,236,421 2/1966 Glazier ..... 222/182

3,964,634 6/1976 Jasinski et al. ..... 220/306 X

*Primary Examiner*—George T. Hall

*Attorney, Agent, or Firm*—Fitzpatrick, Cella, Harper & Scinto

[57] ABSTRACT

Improvements in or relating to caps for containers, particularly aerosol containers, of the type comprising inner and outer skirt portions fast with each other by means of a top disc member, wherein the inner skirt member is seamable to the container through lugs and has a weakened zone which can be filled through rotation of a tab, which is integrating part of the cap and is joined at one end to the outer skirt member through a readily breakable lap.

2 Claims, 5 Drawing Figures

CAPS HAVING FRANGIBLE OPENING MEANS

This invention is concerned with improvements in or relating to caps with whole body diameter for containers, particularly for aerosol containers.

Particularly, but not exclusively referring to aerosol containers, it is known that the trend has spread to use substantially cylindrical caps thereon, the outer diameter of which is substantially coincident with that of the container or bottle.

However, the prior art caps of this type suffer from the disadvantage of being easily removable, with the result that the contents can be delivered prior to purchase from a user, unless resorting to expedients for avoiding any tampering, but involving the provision of an additional element and operation for application thereof.

It is the primary object of the present invention to improve such caps with whole body diameter, of the type comprising an inner skirt portion and an outer skirt portion which are concentrical to each other, so that in addition to protecting the product dispensing head or button, such caps cannot be removed without informing a user that tampering has occurred, and this by making the cap in a single unit and by only one assembling operation.

According to the invention, this and further objects which will become more apparent from the following detailed description, are accomplished in that the inner skirt portion is seamable or attached to the bottle or container by means of lugs and has a weakened zone breakable through rotation of a tab, which is integrating part of the cap and is joined at one end to the outer skirt portion through a readily breakable lap or area.

The invention will be more clearly understood from the following detailed description, given by mere way of unrestrictive example, of a preferred embodiment thereof as shown in the accompanying drawing, in which.

Figure 1:
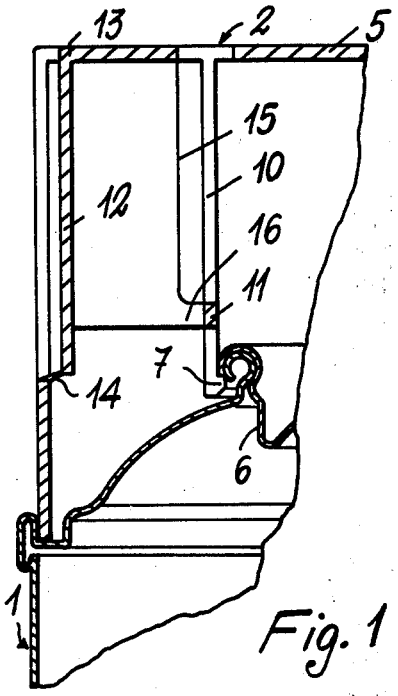
FIG. 1 is a fragmentary longitudinal sectional view showing a cap according to the invention.

Referring to the figures of the accompanying drawing, reference numeral 1 designates as a whole an aerosol bottle and 2 the cap with whole body diameter according to the present invention.

The inventive cap has a cylindrical outer skirt portion 3 and a cylindrical inner skirt portion 4 concentrical to each other and interconnected by a top disc member 5. The inner diameter of skirt portion 4 is standardized for coupling with the outer lip of valve-holder cup 6, the sizes of which are invariable. On the other hand, the outer diameter of skirt portion 3 varies depending on the bottle diameters and is substantially such as to coincide with the latter: therefrom the reference as "whole body diameter".

Along the base contour of inner skirt portion 4 a series of indents 7 are provided as obtained by pressing process, which during cap fitting on the bottle are coupled under a lip 8 of cup 6. Once fitted, said cap 2 cannot be removed because of the indents preventing said inner skirt portion 4 from being extracted. To extract the latter and thereby to gain access to bottle dispensing button 9, it is provided herein to interrupt the continuity of inner skirt portion 4 at a location of its perimeter. This having been done, the intrinsic elasticity of the plastic material, of which the cap is made, allows by a slight stress to deform the gripping locations and accordingly to extract the cap.

According to the invention, the continuity of inner skirt portion 4 is interrupted by breakage of a purposedly preset portion thereof, caused by an external force. To this end, said inner skirt portion 4 has a longitudinal slit 10 provided with a bridge-like element 11 establishing the skirt portion continuity. This bridge-like element is designed so that a force of a few kilograms will suffice for breakage thereof. Still in pressing process of the cap, a tab 12 is formed on said outer skirt portion 3, which tab 12 is fast with the cap only at its top end 13. The bottom end of said tab has a thin lap 14, still provided in cap pressing process, joining it to said outer skirt portion 3.

A rib 15 connects said tab 12 with bridge-like element 11 on inner skirt portion 4. As it will be seen from the accompanying drawing, this rib 15 includes a projection at contact location 16 with said inner skirt portion 4.

Assuming that cap 2 is mounted on bottle 1, security removal operation is as follows.

Figure 2:
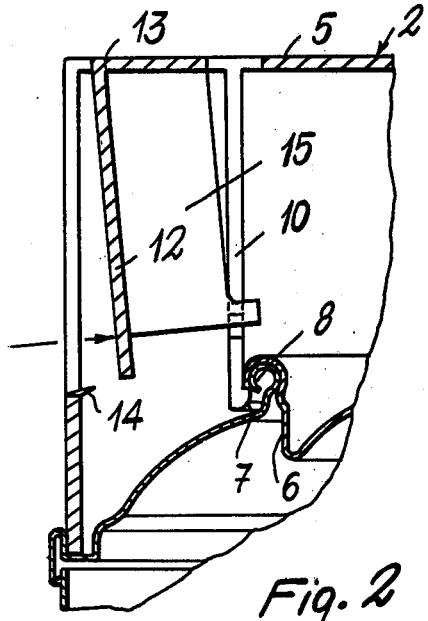
FIG. 2 is a view similar to that of FIG. 1, wherein the tab has been displaced to interrupt the continuity of the inner skirt portion.
Figure 3:
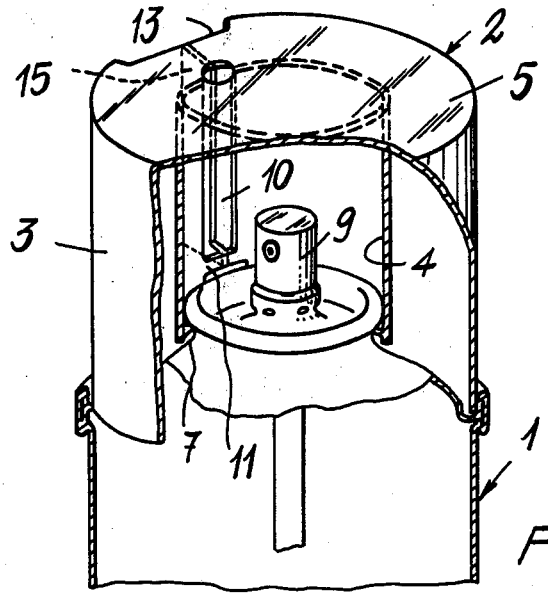
FIG. 3 is a perspective broken away view of the cap.
Figure 4:
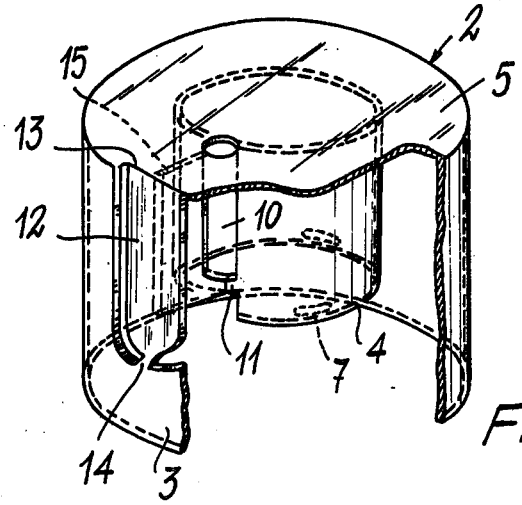
FIG. 4 is still a perspective broken away view of the cap at a different angle of view.
Figure 5:
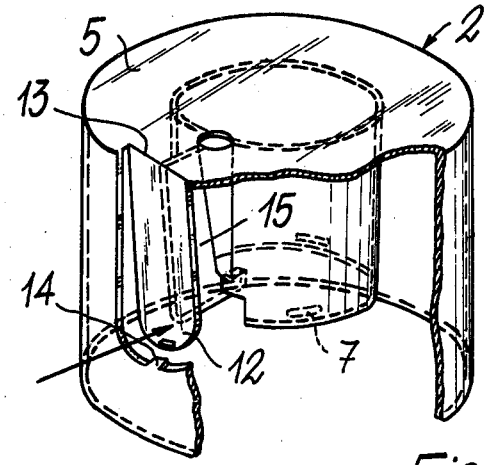
FIG. 5 is a view similar to that of FIG. 4, wherein the tab has been displaced to interrupt the continuity of the inner skirt portion.

With his fingers, a user exerts a pressure on tab 12 in the direction of the arrows in FIGS. 2 and 5. The centreward bending of tab 12 causes the simultaneous breakage of the material joints at locations 11 and 14. FIGS. 2 and 5 show the cap just following the breakage of bridge-like element 11 and accordingly after the continuity of said inner skirt portion 4 has been interrupted.

As apparent, breakage of lap 14 is an evidence that at least a tampering has been attempted, whereas breakage of bridge-like element 11 is for interrupting the circumference continuity and allowing deformation of said inner skirt-portion 4.

Although only one embodiment of the invention has been described, those skilled in the art will now readily devise many changes and modifications, which however are all to be intended as within the scope of the invention.

What I claim is:

1. Improvements in or relating to caps for containers, particularly aerosol containers, of the type comprising inner and outer skirt portions concentrically depending from a top disc member, wherein said inner skirt portion is attached to the container through lugs, said inner skirt portion having a longitudinal discontinuity and a bridge-like member transversing said discontinuity, said bridge-like member being breakable by rotation of a tab, which is an integral part of the cap and is joined at one end to said outer skirt portion by a readily breakable area.

2. An improved cap according to claim 1 wherein said tab includes an inwardly disposed rib having a projection arranged to contact said bridge-like element.

* * * * *

UNITED STATES PATENT AND TRADEMARK OFFICE

CERTIFICATE OF CORRECTION

PATENT NO. : 4,165,014

DATED : August 21, 1979

INVENTOR(S) : Tomaso Ruscitti

It is certified that error appears in the above-identified patent and that said Letters Patent are hereby corrected as shown below:

On the cover page add:

[30] Foreign Application Priority Data

February 24, 1977 Italy.....20643 A/77

Signed and Sealed this

*Fourth* Day of *December 1979*

[SEAL]

*Attest:*

SIDNEY A. DIAMOND

*Attesting Officer*

*Commissioner of Patents and Trademarks*